US005308304A

United States Patent [19]

Habing

[11] Patent Number: 5,308,304

[45] Date of Patent: May 3, 1994

[54] MULTI-HIP EXERCISER

[75] Inventor: Theodore G. Habing, Long Beach, Calif.

[73] Assignee: Pacific Fitness Corporation, Cypress, Calif.

[21] Appl. No.: 918,251

[22] Filed: Jul. 22, 1992

[51] Int. Cl.[5] ..... A03B 21/062

[52] U.S. Cl. ..... 482/99; 482/100; 482/137; 482/908

[58] Field of Search ..... 482/97-100, 482/135-138, 908, 103

[56] References Cited

U.S. PATENT DOCUMENTS

| | | | |
|---|---|---|---|
| 2,977,120 | 3/1961 | Morris | 482/103 |
| 4,600,189 | 7/1986 | Olschansky et al. | 482/100 |
| 4,711,448 | 12/1987 | Minkow et al. | 482/908 |
| 5,067,708 | 11/1991 | Oshansky et al. . | |

FOREIGN PATENT DOCUMENTS

| | | | |
|---|---|---|---|
| 3427769 | 1/1986 | Fed. Rep. of Germany | 482/103 |
| 7609655 | 3/1978 | Netherlands | 482/103 |
| 1151656 | 5/1969 | United Kingdom | 482/102 |
| 2186806 | 8/1987 | United Kingdom | 482/103 |

OTHER PUBLICATIONS

Paramount Fitness Equipment Corporation, Paramount Performance Freeweight Catalogue, "Cable Cross-over", 1991, p. 12.
Titan, CL150 Horizontal Leg Press, and CL290 Total Hip.
Muscle Dynamics, Multi-Hip Machine.
Hoist Fitness Systems, Proline, Multi-Hip.
Flex, FL-116 Iso Hip.
Badger, M24 Cable Cross Over.
Badger, Multi-Hip.
Cybex, Multi-Hip.
Body Master, MD 511, Dual Adjustable Hi/Lo Pulley.
Body Master, MD 114, Multi-Hip.
Pyramid, Multi-Hip.

*Primary Examiner*—Richard J. Apley
*Assistant Examiner*—Jeanne M. Mollo
*Attorney, Agent, or Firm*—Blakely, Sokoloff, Taylor & Zafman

[57] ABSTRACT

An exercising machine that has an adjustable actuator arm assembly coupled to a weight stack by a pulley/cable assembly. The actuator arm assembly includes an actuator arm that lifts the weight stack when rotated through an arc. The machine is constructed with a frame that has a vertical bar. The actuator arm is coupled to a sleeve assembly that can slide along the vertical bar, to provide a number of operating locations. The machine also has a first cable that is coupled to the actuator arm. The cable is looped around a first tension pulley, a first floating pulley and then fixed to the sleeve assembly. The first floating pulley is coupled to a second cable that loops around a second tension pulley and is attached to the weight stack. When the actuator arm is rotated, the first floating pulley is pulled in a downward direction. The movement of the first floating pulley pulls the second cable and lifts the weight stack in an upward direction. When the sleeve assembly is adjusted to a new position on the vertical bar, the cable lengths between the first tension pulley and actuator arm assembly, and between the first floating pulley and sleeve, change an equal and offsetting amount.

11 Claims, 4 Drawing Sheets

FIG. 1
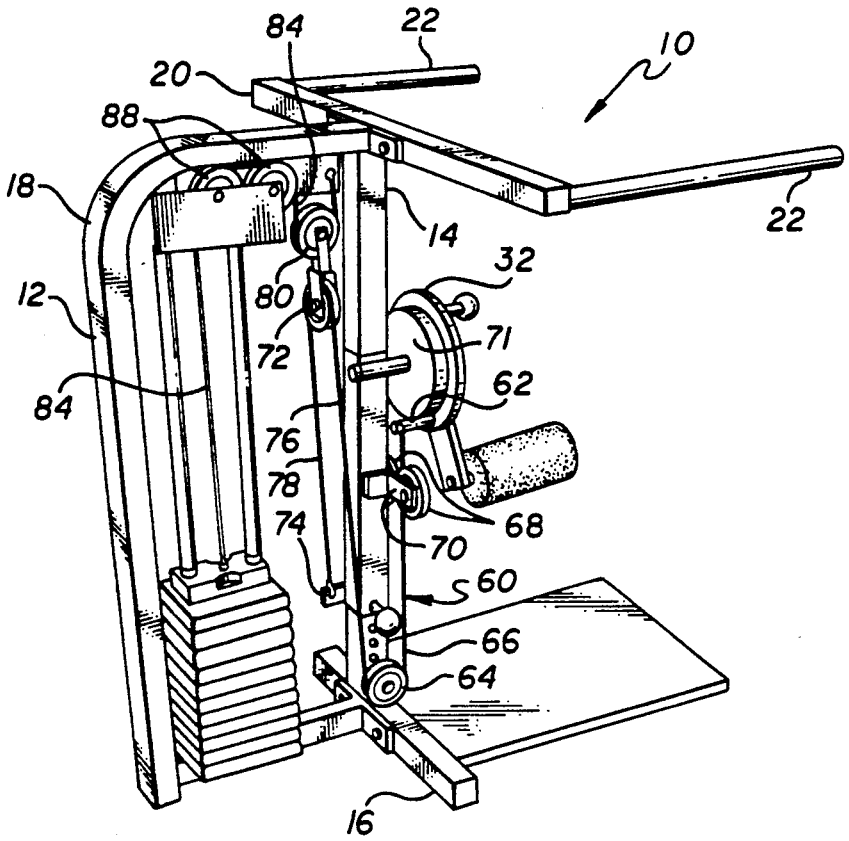
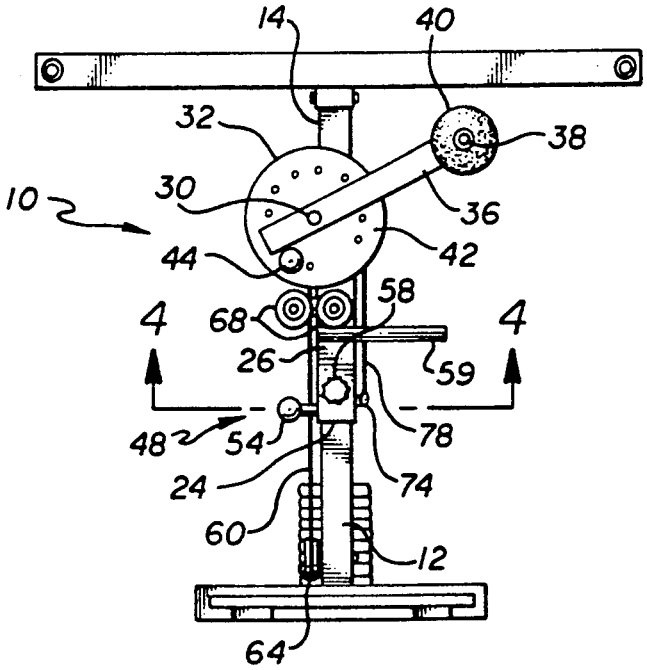
FIG. 2

FIG. 3
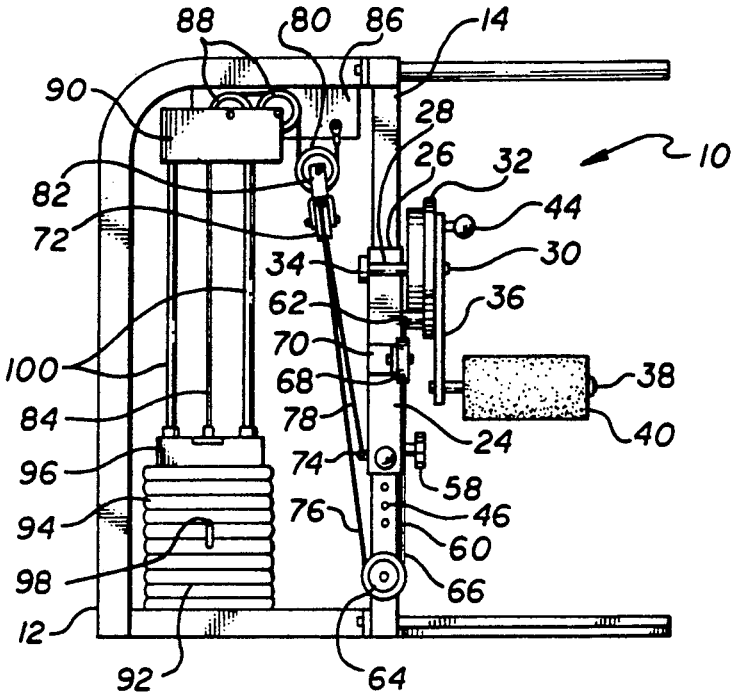
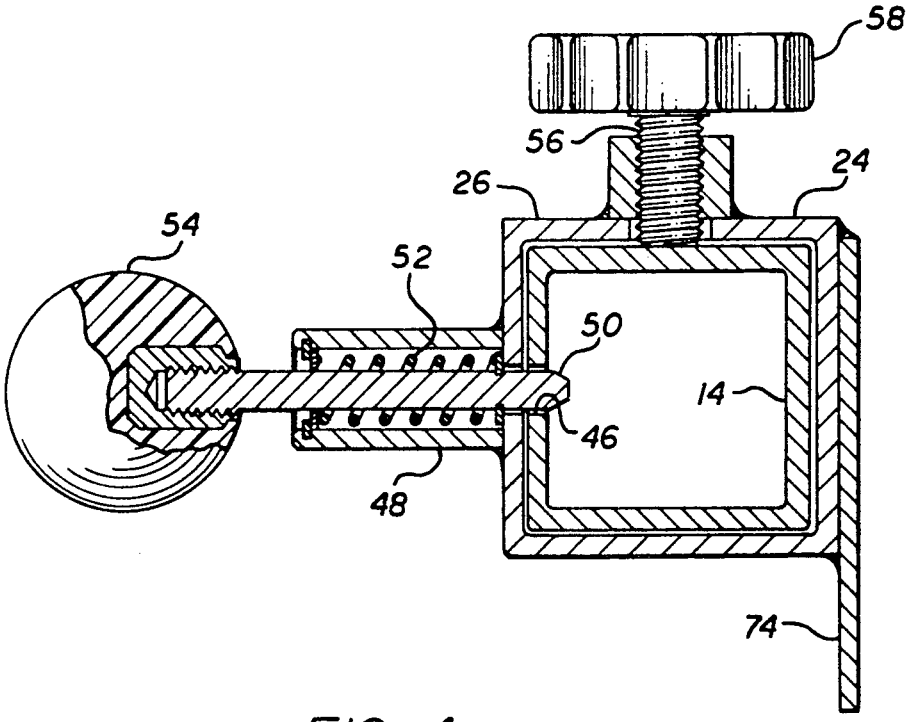
FIG. 4

FIG. 5
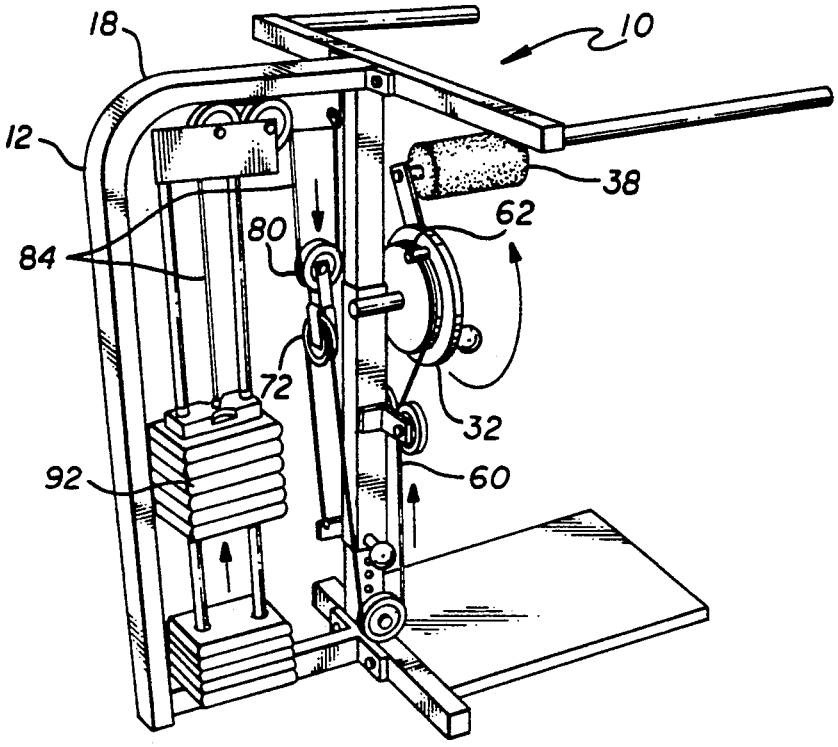
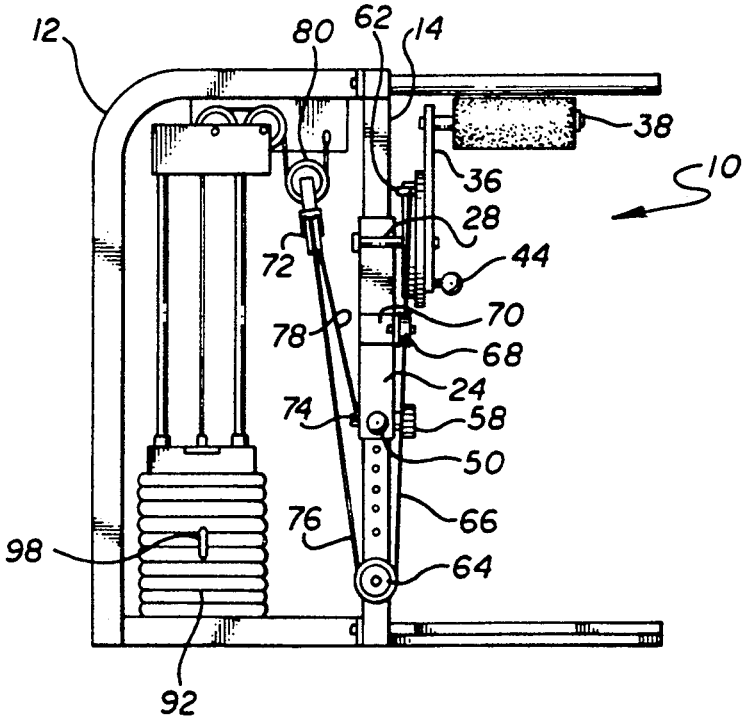
FIG. 6

FIG. 7
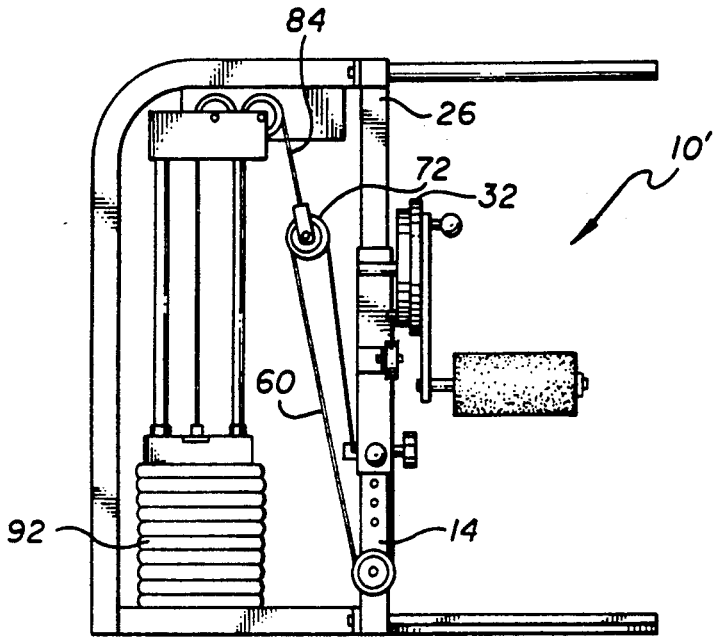
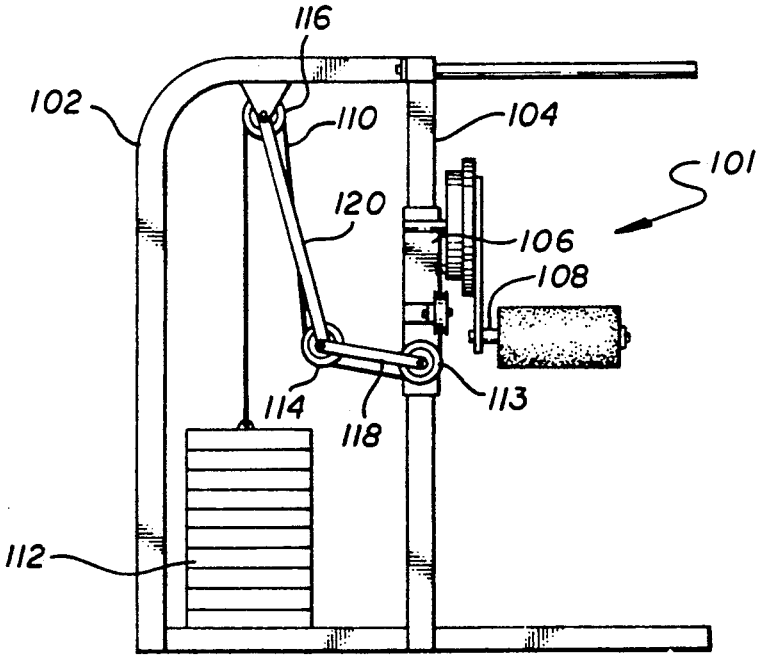
FIG. 8

MULTI-HIP EXERCISER

BACKGROUND OF THE INVENTION

1. Field of the Invention

The present invention relates to exercising equipment, in particular a weight lifting machine.

2. Description of Related Art

Lifting weights has been a historic method of building and toning body muscles. Over the years weight lifting machines have been developed to provide controlled lifting motions and to remove the bulkiness of "free style" weight lifting. A typical weight lifting machine utilizes cables and pulleys to convert human body movement into a vertical translation of weights.

U.S. Pat. No. 5,067,708 issued to Oschansky, discloses an exercise machine that incorporates three cables and a series of pulleys that vertically lift a weight stack in response to the angular displacement of an actuating arm. The Oschansky device includes a frame and an actuator arm assembly that can be adjusted to a number of positions along a vertical bar of the frame. The adjustment means allows the user to vary the height of the actuator arm.

The actuator arm of the Oschansky machine is attached to a cam that is coupled to a vertical translation plate by a pair of chains. The vertical translation plate is coupled to the weight stack by the cable/pulley assembly. The cable/pulley assembly has a pair of floating pulleys that move when the actuator arm assembly is adjusted so that slack is not created in the system. The pulleys do not displace vertically when the actuator arm is rotated during an exercise routine.

Rotation of the actuator arm and cam pulls the translation plate in a downward direction. Movement of the plate pulls the cables and lifts the weight stack. The chains are located off-center from the center line of the plate, so that rotation of the arm and cam in either direction causes one of the chains to pull the translation plate. Such an arrangement creates a torque on the plate. To compensate for the torque, the Oschansky device provides rollers that guide and secure the translation plate within a pair of grooves located in the frame of the machine. The rollers and guides create additional components that increase the complexity and cost of the machine. Additionally, because of the limitations of the plate/chain assembly, the actuator arm of the Oschansky machine cannot be rotated more than 180°. It has been found that some users prefer rotating the arm more than 180°, especially if the user desires a certain amount of pretension in the arm. It would therefore be desirable to provide an exercise machine that provides greater than 180° of rotation. It would also be desirable to have such a machine that allows the actuator arm to be vertically adjusted without effecting the range of rotation of the arm, or the cable tension in the system.

SUMMARY OF THE INVENTION

The present invention is an exercising machine that has an adjustable actuator arm assembly coupled to a weight stack by a pulley/cable assembly. The actuator arm assembly includes an actuator arm that lifts the weight stack when rotated through an arc. The machine is constructed with a frame that has a vertical bar. The actuator arm is coupled to a sleeve assembly that can slide along the vertical bar, to provide a number of operating locations. The machine has a first cable that is coupled to the actuator arm. The cable is looped around a first tension pulley, a first floating pulley and then fixed to the sleeve assembly. The first floating pulley is coupled to a second cable that loops around a second tension pulley and is attached to the weight stack.

When the actuator arm is rotated, the first floating pulley is pulled in a downward direction. The movement of the first floating pulley pulls the second cable and lifts the weight in a vertical direction. When the sleeve assembly is adjusted to a new position on the vertical bar, the cable lengths between the first tension pulley and actuator arm, and between the first floating pulley and sleeve, change an equal and offsetting amount. The offsetting changing cable lengths prevents movement of the floating pulley and insures that the cable is always in tension when the sleeve assembly is adjusted to a new location. By keeping the first floating pulley stationary for all sleeve locations, the present invention allows the user to adjust the height of the actuator arm without affecting the travel of the pulley or the rotational range of the arm. Additionally, the cable is coupled to the actuator arm, so that the arm can rotate more than 180°.

Therefore it is an object of the present invention to provide an exercise machine that can provide a plurality of operating positions.

It is also an object of the present invention to provide an exercise machine with an actuator arm that can be rotated more than 180°.

It is also an object of the present invention to provide an exercise machine that can convert the angular displacement of an actuator arm into a vertical movement of weights, and allow the actuator to be moved to a plurality of vertical positions while maintaining tension in the cables and without affecting the rotational range of the arm.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 1 is a perspective view of an exercise machine of the present invention;

FIG. 2 is a front view of the exercise machine of FIG. 1;

FIG. 3 is a side view of the exercise machine of FIG. 1;

FIG. 4 is a cross-sectional view of the machine of FIG. 1, showing a captured spring loaded pin inserted into the hole of a frame;

FIG. 5 is a perspective view of the exercise machine of FIG. 1, with an actuator arm rotated and weights lifted in a vertical direction;

FIG. 6 is a side view of the exercise machine of FIG. 1 showing the actuator arm moved into a different location;

FIG. 7 is a side view showing an alternate embodiment of the exercise machine of FIG. 1;

FIG. 8 is a side view of another alternate embodiment of the present invention.

DETAILED DESCRIPTION OF THE INVENTION

Referring to the drawings more particularly by reference numbers, FIG. 1 shows an exercise machine 10 of the present invention. The machine 10 includes a frame 12 typically constructed from a tubular metal such as steel, which provides a strong and relatively lightweight structure. The frame 12 has a vertical bar 14 rigidly connected to a T shaped base 16. Also attached to the base 16 is a rear support bracket 18. The rear bracket 18 may be rounded to improve the safety and appearance of the machine. The vertical bar 14 and rear bracket 18 are both connected to a handle bracket 20. Extending from the handle bracket 20 are a pair of handle bars 22. The bars 22 provide an object for the user to grab while operating the machine. The surface of the bars 22 may be treated or covered to improve the grip of the same. The brackets, bar and base can all be bolted and/or welded together to provide a rigid frame structure.

As shown in FIGS. 2 and 3, the machine 10 has a sleeve assembly 24 attached to the frame 12. The sleeve assembly 24 includes a sleeve 26 that can slide along the vertical bar 14. Attached to the top of the sleeve 26 is a tubular bearing 28. Extending through the bearing 28 is the axle 30 of an actuator arm 36. The axle 30 extends through the cam selector plate 32 so that the arm 36 can rotate relative to the plate 32. A shaft collar 34 is attached to the end of the axle 30 to prevent the arm 36 and cam 32 from becoming detached from the sleeve 26.

Extending from the arm 36 is a pad shaft 38. A pad 40 may surround the pad shaft 38 to provide comfort for the user. The cam selector plate 32 may have a plurality of holes 42 arranged in a circular manner. The arm 36 has a captured spring loaded pin 44 that can be inserted into the wheel holes 42. The pin 44 can be pulled out of the cam 32 so that the arm 36 can be rotated to change the position of the pad shaft 38 and pad 40. The pin 44 and hole 42 arrangement allows the user to adjust the angular position of the arm 36 relative to the cam selector plate 32.

The vertical bar 14 has a plurality of holes 46 that provide a number of sleeve locations. As shown in FIG. 4, the sleeve 26 has a pin housing 48 that contains a pin 50 and a spring 52. The pin 50 extends through the sleeve 26 and can be inserted into one of the bar holes 46. The pin 50 also has a handle 54 that allows the user to pull the pin 50 out of the hole 46 and move the sleeve 26 relative to the bar 14. The pin housing 48 is rigidly connected to the sleeve 26 so that when the sleeve 26 is moved, the pin 50 must be displaced. The sleeve assembly 24 may also have a captured screw 56 that extends through the top portion of the sleeve 26. The screw 56 has a handle 58 that allows the user to rotate the screw 56 in a clockwise or counterclockwise direction. The screw 56 can engage the vertical bar 14 to further secure the sleeve 26 to the frame 12.

To move the sleeve assembly 24, the user rotates the handle 58 and disengages the screw 56 from the bar 14. The pin 50 is pulled out of the hole 46 and the sleeve 26 is moved to the desired location. The pin handle 54 is then released such that the pin 50 enters a new hole 46. Alternatively, the pin handle 54 may be released in the proximity of the desired location and the sleeve 26 can be moved until the pin 50 "pops" into the new hole 46. The screw 56 is then rotated to further secure the sleeve 26 to the frame 12. The pin 50 and hole 46 arrangement allows the user to move the actuator arm 36 into a variety of vertical locations along the vertical bar 14. The sleeve 26 may have a bar 59 that provides a handle for the user to grab while moving the actuator arm 38 along the vertical bar 14.

As shown in FIG. 1, the machine 10 has a first cable 60 with one end attached to the cam selector plate 32 by a pin 62. The cable 60 loops around a first tension pulley 64 that is attached to the vertical bar 14. The first tension pulley 64 is allowed to rotate relative to the frame 12. The distance from the wheel pin 62 to the first tension pulley 64 defines a first cable length 66. The sleeve assembly 24 may also have a pair of pulleys 68 attached to the sleeve 26 by a bracket 70. The pulleys 68 keep the cable 60 essentially linear with the bar 14, when the cam selector plate 32 is rotated and the pin 62 moves through an angular displacement. The pulleys 68 provide a guide for the cable 60, so that the cable 60 has a greater displacement as it goes around the cam 71 of the cam selector plate 32.

The first cable 60 goes from tension pulley 64 and loops around a first floating pulley 72 and is connected to an attachment bracket 74 extending from the sleeve 26. The distance from the first tension pulley 64 to the first floating pulley 72 defines a second cable length 76. The distance from the first floating pulley 72 to the attachment bracket 74 defines a third cable length 78. The first floating pulley 72 is connected to a second floating pulley 80. The floating pulleys are each pivotally connected to a pulley bracket 82 that allows the pulleys to freely rotate.

The second floating pulley 80 is suspended from the frame 12 by a second cable 84. In this manner, the first 72 and second 80 floating pulleys are supported by the first 60 and second 84 cables. One end of the second cable 84 is connected to a first pulley bracket 86 attached to the rear bracket 18. The second cable 84 loops around a pair of second tension pulleys 88 that are attached to the first pulley bracket 86 and a second pulley bracket 90. Although two separate second tension pulleys 88 are described and shown, it is to be understood that a single pulley with a sufficient radius could be utilized.

The second cable 84 is attached to a weight stack 92. The weight stack 92 is comprised of a number of individual weights 94. The weights 94 are coupled to a lift plate 96 which is fixed to the cable 84. The lift plate 96 has a rod (not shown) that extends through the weights 94. A pin 98 can be inserted between two individual weights to couple a number of weights to the plate 96, as is known in the art. Extending from the second pulley bracket 90 are a pair of guide bars 100 that guide the weights 94 when the same are lifted in a vertical direction.

As shown in FIG. 5, when a user applies a force to the pad 40, the actuator arm 36 moves through an angular displacement. The arm 36 engages the pin 44 and rotates the cam selector plate 32. Rotation of the plate 32 pulls the first cable 60 in a first direction indicated by the arrow. The force of the cable 60 pulls the floating pulleys 72 and 80, in a second opposite direction. Movement of the second floating pulley 80 exerts a force on the second cable 84 and pulls the weight stack 92 in an upward vertical direction as shown in FIG. 5. When the user reduces or removes the force from the actuator arm 36, the weight of the weight stack 92 moves the weights to a new position (if the force is removed, the weights move to the original rest position). The movement of the weights induces a force in the second cable 84 which pulls the floating pulleys back toward the support bracket 18. The translation of the pulleys creates a force in the first cable 60, which rotates the cam selector plate 32 and the actuator arm 36, accordingly. The floating pulleys 72 and 80 can move along the entire length of the frame 12, thereby allowing a maximum range of arm 36 rotation.

The present invention allows the user to vary the vertical location of the actuator arm 36 without effecting the operation or performance of the machine 10. FIG. 6 shows the sleeve assembly 24 moved to a higher vertical position on the vertical bar 14. Repositioning the sleeve assembly 24 is performed by releasing and reattaching the pin 50 and screw 56 as previously described. When the assembly 24 is moved downward as shown, the first cable length 66 (distance between the wheel pin 62 and first tension pulley 64) decreases an amount equal to the displacement of the sleeve 24. The second cable length 76 (distance between the first tension pulley 64 and first floating pulley 72) remains constant. The third cable length 78 (distance between the first floating pulley 72 and the attachment bracket 74) increases an amount equal to the sleeve displacement. The increase in the length of the third cable length 78 is equal to the decrease in the length of the first cable length 66, so that the first cable 60 is always in tension when the sleeve assembly 24 is moved down the vertical bar 14. Likewise, when the assembly 24 is moved back in an upward vertical direction, the third cable length 78 will decrease an amount equal to the increase in the first cable length 66. Because the second cable length 76 does not vary, the floating pulleys 72 and 80 do not move when the sleeve assembly 24 is repositioned. The floating pulleys can therefore always move along the entire length of the frame 12. The present invention provides an exercise machine that allows the user to vary the height of the actuator arm 36, without effecting the cable tension of the system or the range of arm rotation. The machine 10 may also include a counter weight that biases the sleeve in an upward direction. The counterweight prevents the sleeve from falling down when the user disengages the pin 50 and screw 56 from the vertical bar 14.

FIG. 7 shows an alternate embodiment of the present invention wherein the second floating pulley is removed and the end of the second cable 84 is attached directly to the pulley 72. The modified machine 10' operates similar to the machine described above. When the cam selector plate 32 is rotated, the first floating pulley 72 is pulled in a first downward direction. The movement of the pulley creates a force on the second cable 84 which pulls the weight stack 92 in an upward vertical direction. Translation of the sleeve 26 along the vertical bar 14 does not move the floating pulley 72 or create slack in the cable 60.

FIG. 8 shows a another embodiment 101 of the present invention. The machine 101 has a frame 102 with a vertical bar 104. The machine 101 also has a sleeve assembly 106 that can be moved and attached to the bar 104 in a manner similar to the sleeve assembly 24 shown in FIG. 1. The sleeve assembly 106 includes an actuator arm 108 that can be rotated relative to the frame 102. A first cable 110 couples the sleeve assembly 106 to a weight stack 112, such that angular movement of the actuator arm 108 induces a vertical linear displacement of the weight stack 112. The cable 110 loops around a first pulley 113, a second pulley 114 and a third pulley 116. The third pulley 116 is connected to the frame 102. A first linkage arm 118 is pivotally connected to the first pulley 113 and the second pulley 114. A second linkage arm 120 is pivotally connected to the second 114 and third 116 pulleys. The linkage arms allow the second pulley 114 to move relative to the frame 102.

When the sleeve assembly 106 is moved along the vertical bar 104, the second pulley 114 moves relative to the frame 102. The first linkage arm 118 insures that the distance between the first pulley 113 and second pulley 114 is constant. Likewise, the second linkage arm 120 insures that the distance between the second 114 and third 116 pulleys is always constant. The fixed spatial relationship of the pulleys and arms, insures that the cable 110 will always remain in tension, even when the sleeve assembly 106 is moved into a different vertical position on the frame 104.

While certain exemplary embodiments have been described in detail and shown in the accompanying drawings it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An exercising apparatus, comprising:

a frame;

a sleeve operatively connected to said frame;

an actuator arm operatively connected to said sleeve and adapted to rotate about a horizontal axis relative to said frame;

a first cable having a first end coupled to said actuator arm and a second end attached to said sleeve frame;

a weight adapted to move relative to said frame;

a first floating cable guide coupled to said first cable; and a second cable coupled to said first floating cable guide and connected to said weight.

2. The apparatus as recited in claim 1, wherein said actuator arm is adapted to rotate more

3. The apparatus as recited in claim 2, wherein said sleeve can be positioned at one of at least two locations relative to said frame.

4. The apparatus as recited in claim 3, further comprising a second floating cable guide connected to said first floating cable guide and coupled to said second cable.

5. The apparatus as recited in claim 4, wherein said first and second floating cable guides are pulleys.

6. An exercising apparatus, comprising:

a frame having a bar;

a sleeve adapted to slide over said bar;

attachment means for detachably connecting said sleeve to said frame such that said sleeve can be positioned at one of at least two locations on said bar;

an actuator arm operatively connected to said sleeve, said actuator arm being adapted to rotate about a horizontal axis relative to said frame;

a weight adapted to move relative to said frame;

a first cable having a first end attached to said actuator arm and a second end attached to said sleeve;

a first floating cable guide coupled to said first cable such that said first floating cable guide remains in a same stationary position when said sleeve is moved relative to said frame; and, a second cable coupled to said first floating cable guide and connected to said weight.

7. The apparatus as recited in claim 6, further comprising a second floating cable guide connected to said first floating cable guide and coupled to said second cable.

8. The apparatus as recited in claim 7, further comprising a first tension cable guide coupled to said first cable and a second tension cable guide coupled to said second cable.

9. The apparatus as recited in claim 8, wherein said floating and tension cable guides are pulleys.

10. An exercising apparatus, comprising:

a frame having a bar;

a sleeve adapted to slide over said bar;

attachment means for detachably connecting said sleeve to said frame such that said sleeve can be positioned at one of at least two locations on said bar;

a cam selector plate coupled to said sleeve, said cam selector plate being adapted to rotate relative to said sleeve and said frame;

an actuator arm operatively connected to said cam selector plate such that movement of said actuator arm rotates said cam selector plate;

a first cable attached to said cam selector plate and said sleeve;

a first tension pulley attached to said frame and coupled said cam selector plate by said first cable;

a first floating pulley coupled to said first tension pulley and said sleeve by said first cable such that said first floating pulley remains in a same stationary position when said sleeve moved relative to said frame;

a second cable attached to said first floating pulley;

a weight attached to said second cable; and a second tension pulley attached to said frame and coupled to said first floating pulley by said second cable.

11. An exercising apparatus, comprising:

a frame having a bar;

a sleeve adapted to slide over said bar;

attachment means for detachably connecting said sleeve to said frame such that said sleeve can be positioned at one of at least two locations on said bar;

a cam selector plate coupled to said sleeve, said cam selector plate being adapted to rotate relative to said sleeve and said frame;

an actuator arm operatively connected to said cam selector plate such that movement of said actuator arm rotates said cam selector plate;

a first cable attached to said cam selector plate and said sleeve;

a first tension pulley attached to said frame and coupled to said cam selector plate by said first cable;

a first floating pulley coupled to said first tension pulley and said sleeve by said first cable;

a second floating pulley connected to said first floating pulley;

a second cable attached to said frame and coupled to said second floating pulley;

a weight attached to said second cable; and, a second tension pulley attached to said frame and coupled to said second floating pulley by said second cable.

* * * * *

UNITED STATES PATENT AND TRADEMARK OFFICE

CERTIFICATE OF CORRECTION

PATENT NO. : 5,308,304

DATED : May 3, 1994

INVENTOR(S) : Habing

It is certified that error appears in the above-identified patent and that said Letters Patent is hereby corrected as shown below:

column 6, line 35, after "to rotate more"
add -- 180°--.

Signed and Sealed this

Twenty-fifth Day of April, 1995

*Attest:*

*Attesting Officer*

BRUCE LEHMAN

*Commissioner of Patents and Trademarks*